United States Patent [19]

Meatto et al.

[11] Patent Number: 4,688,821

[45] Date of Patent: Aug. 25, 1987

[54] ASYMMETRIC ALPINE SKI WITH OFFSET BOOT PLATFORM

[75] Inventors: Franklin D. Meatto, Cromwell; Edward D. Pilpel, Avon, both of Conn.

[73] Assignee: TriStar Sports, Inc., Middletown, Conn.

[21] Appl. No.: 808,922

[22] Filed: Dec. 13, 1985

[51] Int. Cl.[4] ..... A63C 5/04

[52] U.S. Cl. ..... 280/609; 280/610

[58] Field of Search ..... 280/601, 609, 610, 607

[56] References Cited

U.S. PATENT DOCUMENTS

| | | | |
|---|---|---|---|
| 2,510,794 | 6/1950 | Beerli | 280/610 X |
| 3,304,095 | 2/1967 | Carlton | 280/609 |
| 3,501,160 | 3/1970 | Lange | 280/609 |
| 3,917,298 | 11/1975 | Haff | 280/607 |
| 4,377,297 | 3/1983 | Staufer | 280/609 |

FOREIGN PATENT DOCUMENTS

| | | | |
|---|---|---|---|
| 262116 | 5/1968 | Austria | 280/609 |
| 2701729 | 7/1978 | Fed. Rep. of Germany | 280/601 |
| 3045853 | 6/1982 | Fed. Rep. of Germany | 280/601 |
| 3220688 | 12/1982 | Fed. Rep. of Germany | 280/601 |
| 2559673 | 8/1985 | France | 280/610 |
| 595118 | 1/1978 | Switzerland | 280/609 |

OTHER PUBLICATIONS

SKI Magazine, Sep. 1976 Edition, pp. 128 and 117.
Skiing Magazine, Oct. 1976 Edition, p. 168.
Skiing Mechanics, John G. Howe, 1983 pp. 22–24 and 101–104.

*Primary Examiner*—Nancy A. Swisher
*Attorney, Agent, or Firm*—Ralph D'Alessandro; Thomas P. O'Day

[57] ABSTRACT

In an alpine snow ski there is provided an asymmetric design in which the inside edge of the ski has a large sidecut with a short radius of curvature such that the centerline of a skier's foot when positioned in mounting plates on top of the ski is between about 5 and about 20 millimeters to the interior of the ski's inside edge and the mounting plates overhang the inside edge of the ski. The mounting plates are adjustable transversely to the inside edge of the ski and the outside edge of the ski is straight.

67 Claims, 8 Drawing Figures

ASYMMETRIC ALPINE SKI WITH OFFSET BOOT PLATFORM

BACKGROUND OF THE INVENTION

This invention relates generally to a snow ski structure. More specifically, it is concerned with the design of the ski sidecut and the relationship of the skier's foot on the ski to the inside edge and the sidecut of the ski, and how that positioning increases the efficiency of the moment arm about the inside edge, as well as impacting on the turning ability of the ski.

Downhill skiing has increased in popularity since its recreational introduction, focusing attention on the structure and design of skis to produce skis that provide increased speed and greater responsiveness to the improved skiing techniques employed by skiers today. The materials employed in alpine skis have been changed in response to the need to develop higher performance skis at lower manufacturing costs. Materials have been employed which have lightened the weight of the skis, while strengthening them. Today's skis are typically laminated structures with discrete layers of polyethylene, fiberglass, thin layers of rubber and core material, coupled with bottom and top edges, between the bottom running surface and the top facing surface. Little has been done, however, to improve the ability of skiers to control their skis during use or to make it easier to execute turns.

One of the most difficult problems for beginning skiers, and a continuing problem for skiers with intermediate skills, is the ability to control the skis during the initiation and execution of a turn. Properly executed turns are initiated by the gradual shifting of the skier's weight to one ski, which either already is or rapidly becomes the downhill ski, to cause the ski to begin to flex. Specifically, as the skier's weight is moved toward the inside edge of the downhill ski, thus putting the ski up on this edge, the ski begins to flex as the ski skids and slides through its turn.

For the purposes of further discussion, it is to be understood that the term skid or skidding describes movement of the skis across or transverse to the fall line of a ski slope. Similarly, slide or sliding describes movement of the skis parallel to the fall line of a ski slope. A pure carved turn is the desired type of turn and is one in which the ski follows its arc without any transverse skidding. The arc of the ski is the shape of the ski created by its sidecut and flexure.

There are numerous types of skis for the novice to intermediate skier which attempt to provide a product that will accomodate the normally less aggressive skiing style of these non-racing or infrequent skiers. Such skiers will initiate generally wide turns at moderate to high speeds. Most skis have attempted to accomodate skiers in this range by having a short, stiff ski with a center to back-weighted flexural distribution that permits a skidding or sliding technique in turns. Other designs utilize a relatively abrupt flexural transition with low camber and beveling to offer some limited carving capability, in addition to easier skidding and sliding capability. However, none of these types of skis have attempted to make the mechanics of initiating and executing turns easier for the novice and intermediate skier.

The sharpness of the turn executed is based upon the sidecut geometry of the ski; the deeper the sidecut or the longer the arc length or the shorter the radius of curvature forming the sidecut, the sharper the turn that can be executed. However, the amount of effort necessary to initiate a turn and to angulate the ski with respect to the snow surface is partially a function of the positioning of the skier on the skis. In all of the traditional skis, the positioning of the centerline of the foot and the centerline of the ski boot on the ski has generally been over the centerline of the ski extending between the front or shovel and the rear or tail. A skier must exert, therefore, considerable effort to get up or angle the downhill ski on the inside edge and to rotate the skis to initiate a turn and to accomplish a short or tight turn with current designs.

Novice to intermediate skiers, however, do not uniformly, nor properly, execute turning techniques because of inability to put the skis on edge, mistimed and improper rotation of the skis, improper application of pressure to the skis, and improper sequencing of the angulation, rotation and pressure steps.

The foregoing problems are solved in the present invention by providing a ski design which combines deep sidecut geometry and skier placement to assist the skier by providing a mechanical advantage to engage the inside edge. This provides a ski that is responsive turn to turn and initiates carved short radius turns quickly and relatively easily without loss of the rotational skidding and sliding characteristics of a standard ski design.

SUMMARY OF THE INVENTION

It is an object of the present invention to provide an alpine ski design with a sidecut radius and a mechanical advantage that permits shorter turns at lower speeds to be more easily accomplished.

It is another object of the present invention to provide an alpine snow ski which, by the combination of the sidecut geometry and the skier placement, provides a ski with which it is easier to initiate turns and which is more responsive between turns than standard ski designs.

It is still another object of the present invention to provide an alpine snow ski that is responsive with less skier effort than is required by conventional alpine skis.

It is another object of the present invention to provide an alpine ski design that increases the skier's control of the speed and direction of the ski during usage.

It is a feature of the present invention that the mounting means on the ski position the foot of the skier such that the distance between the centerline of the foot and the inside edge of the ski is between about 5 and about 20 millimeters.

It is another feature of the present invention that the mounting means is adjustable transversely with respect to the longitudinal centerline of the shovel of the ski.

It is still another feature of the present invention that the ball of the skier's foot, when positioned in the mounting means of the ski, is adjacent the inside edge and along a line parallel to the direction of travel at a distance from the center of the contact length of between about 50 millimeters to the front toward the shovel and about 50 millimeters to the rear toward the tail of the ski.

It is yet another feature of the present invention that the sidecut is much deeper and the radius of curvature forming the sidecut is radically shorter than standard ski designs.

It is a further feature of the present invention that the ski design is asymmetric with the inside edge being curved and the outside edge being straight.

It is yet another feature of the present invention that the sidecut geometry of the ski of the present design is described by the general formula for a circle in Cartesian space, the radius of the circle being between about 10 meters and about 85 meters.

It is still another feature of the present invention that the left ski is a mirror image of the right ski.

It is an advantage of the present invention that an alpine ski is provided which provides greater control and improved responsiveness during traversing on steep terrain.

It is another advantage of the present invention that a quicker inside edge set and greater control is achieved by a substantial reduction in the moment of inertia about the inside edge of the ski required to achieve the desired edge angulation.

It is still another advantage of the present invention that a greater turn initiation angle, almost three times greater than traditional designs, is achieved which results in quicker turn initiation.

It is yet another advantage of the present invention that the alpine ski is quicker responding with less skier input to achieve the required edge angulation to initiate and execute carved short radius turns.

These and other objects, features and advantages are obtained by providing in an alpine snow ski tranversely adjustable mounting means intermediate the shovel and tail of the ski such that the distance between the center line of the foot and the inside edge is between about 5 and about 20 millimeters, while the radius of the curvature of the sidecut is described by the equation $R=[(x-A)^2+(y-B)^2]^{\frac{1}{2}}$, the radius being between about 10 and about 85 meters. The ball of the foot is located along a line parallel to the direction of travel at a point along the line between about 50 millimeters to the front or the rear of the center of the contact length of the ski.

BRIEF DESCRIPTION OF THE DRAWINGS

The advantages of this invention will become apparent upon consideration of the following detailed disclosure of the invention, especially when it is taken in conjunction with the drawings wherein.

DETAILED DESCRIPTION OF THE PREFERRED EMBODIMENT

Figure 1:
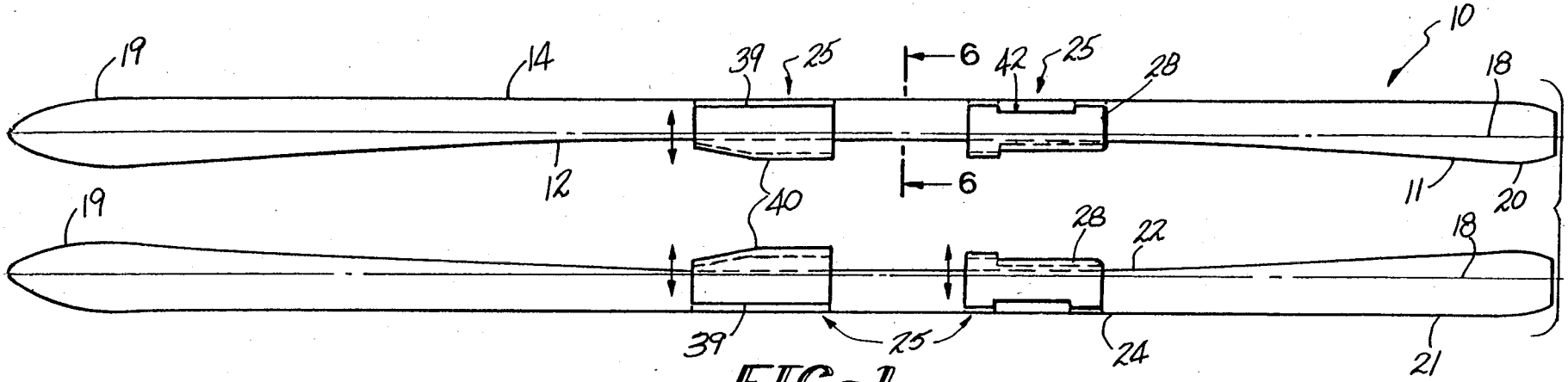
FIG. 1 is a top plan view of a pair of left and right skis showing the longitudinal centerlines of the shovels of the skis, the inside edges and the transverse adjustability of the mounting plates.

FIG. 1 shows a pair of asymmetric alpine skis, indicated generally by the numeral 10 wherein the top ski is the right ski 11 and the bottom ski is the left ski 21. Ski 11 will be discussed in detail hereafter, but it is to be understood that ski 21 is the mirror image of ski 11. Because of the asymmetry, the left and right skis must be worn on the intended foot and cannot be switched.

Ski 11 has a first side 12 which has a deep sidecut geometry dictated by a short radius of the curvature forming the sidecut on its inner side. The second side 14 is generally straight on the ski's outer side. The second side 14 and its attached outside edge (not shown) extend in a direction that is generally parallel to the direction of travel of the ski 11 when no external forces are exerted to cause lateral movement or initiate a turn. The longitudinal centerline 18 of the shovel 19 is shown extending from the shovel 19 at the front of the ski to the tail 20 at the rear. This centerline 18 is midway between first side 12 and second side 14 through the center of the shovel 19. In the asymmetric ski design of the present invention, it is seen that in the central or waist portion of the ski 11 the first side 12 and the centerline 18 approach one another in a near tangent relationship. Depending upon the radius of curvature selected and the length of the ski 11, this centerline 18 can intersect and pass outside of the first side 12. The ski 11, as seen in FIG. 3 in a bottom plan view, shows the positioning of the inside edge 15 and the outside edge 16.

Figure 2:
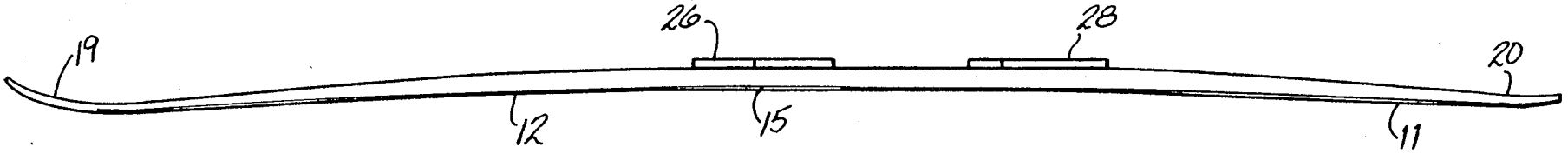
FIG. 2 is a side elevational view of the right ski.
Figure 3:
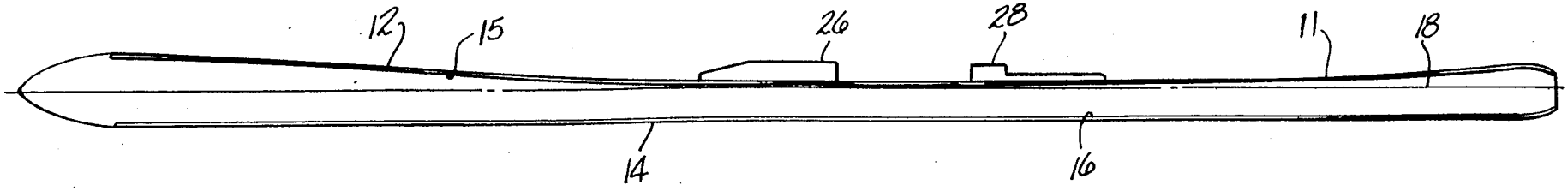
FIG. 3 is a bottom plan view of the right ski showing the centerline of the shovel of the ski in relation to the inside edge of the ski.
Figure 5:
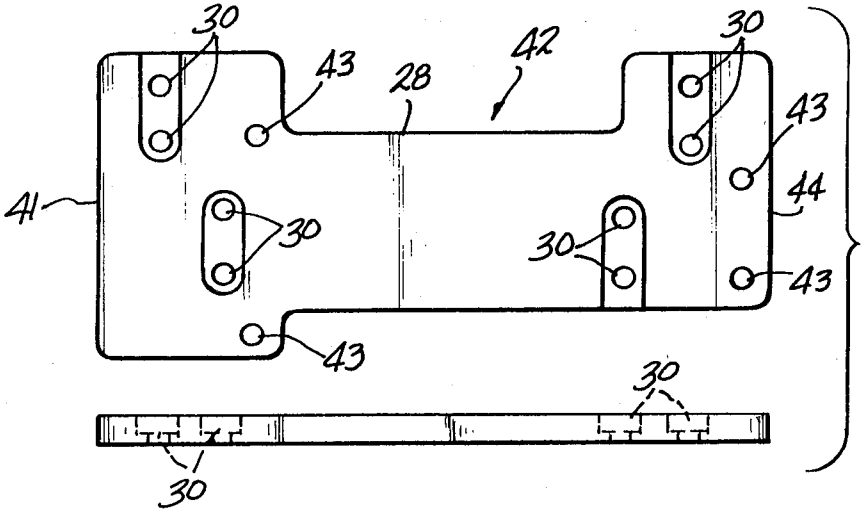
FIG. 5 is a composite view of the top plan and side elevational views of the rear mounting plate.
Figure 4:
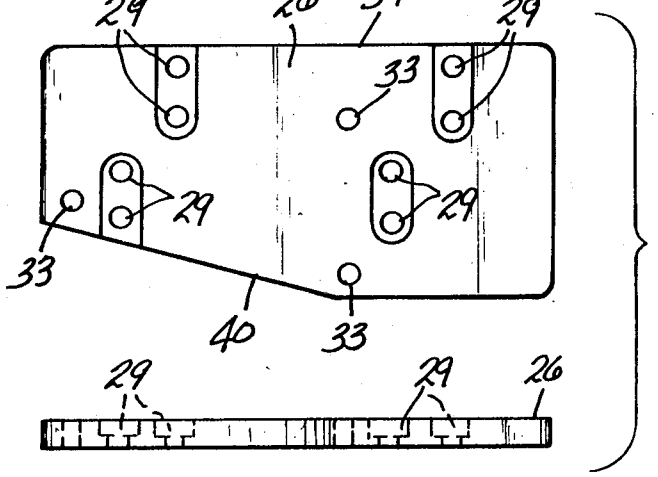
FIG. 4 is a composite view of the top plan and side elevational views of the front mounting plate.

Mounting means, indicated generally by the numeral 25 are shown on the skis 11 and 21 in FIG. 1 on ski 11 in FIGS. 2 and 3, and separately in FIGS. 4 and 5. Mounting means 25 consist of a front or first mounting plate 26 and a rear or second mounting plate 28. These plates 26 and 28 are held in position on the skis 11 and 21 by a plurality of screws (not shown) that are inserted into front mounting plate through holes 29 and rear mounting plate through holes 30. Multiple sets of through holes 29 and 30 are provided because the mounting plates 26 and 28 are adjustable tranversely with respect to the direction of travel of the ski or the longitudinal centerline 18 of the shovel of each ski 11 and 21. This permits the positioning of the skier's foot and boot, as will be explained later, to be adjusted with respect to this centerline of the shovel and the inside edge 15. This transverse adjustability is shown in FIG. 1 by the positioning of the mounting means in a first position shown in solid lines and in a second position, less offset from the shovel centerline 18 and the inside edges, in dashed lines. Mounting plates 26 and 28 have tapped holes 33 and 43, respectively, to receive binding mounting screws (not shown) when separate mounting plates and bindings are employed.

As shown, mounting means 25 may have the bindings for the ski boots fastened directly to them. Alternately, the mounting means 25 may equally well be the bindings themselves by having the bindings manufactured to provide the overhanging or offsetting relationship with the inside edges of the skis 10, as well as providing the traditional boot retaining function. Similarly, while shown as two separate components for each ski, mounting means 25 could be a single component for each ski.

Front or first mounting plate 26 and rear or second mounting plate 28 are shown in FIGS. 4 and 5. These plates act as flight decks to support the skier's foot and boot as they extend over the side of the ski. Front or first mounting plate 26 is shown as having a first side 39 that is generally parallel to the second or outer side 14 of ski 11 and a second side 40 that overhangs the first side 12 and its inside edge 15 of ski 11 and angles inwardly at its front portion toward the first side 12 and inside edge 15. This is best seen in FIGS. 1 and 4. Rear mounting plate 28 has a head portion 41 with a cut-out portion 42 and a tail portion 44, best seen in FIG. 5. Second mounting plate 28 is shown with the cut-out portion 42 being nearest the second or outer side 14 of ski 11 in FIG. 1. Both the first and second mounting plates 26 and 28 are shown in FIG. 1 as being transversely adjustable.

Figure 6:
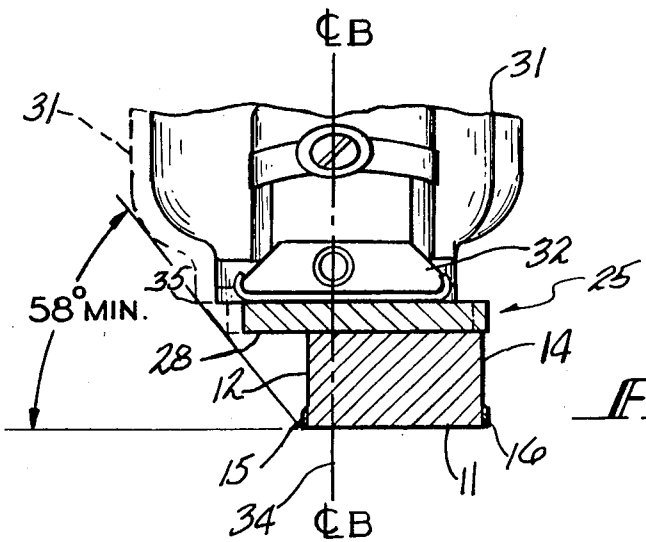
FIG. 6 is a partial rear elevational view of the skier's boot in the mounting plate taken along the sectional lines 6—6 of FIG. 1 showing the relationship of the centerline of the boot to the inside edge of the ski.

As best seen in FIGS. 1, 3, and 6 mounting means 25 overhang the first or inner side 12 and the attached bottom inside edge 15 of ski 11. As seen in FIG. 6, this locates the centerline 34 of ski boot 31 with the skier's foot inside at a distance from the inside edge 15 that is between about 5 and about 20 millimeters from the inside edge 15 of the ski in the central section of the ski.

FIG. 6 shows a portion of the ski boot 31 and the rear portion of a ski binding 32, illustrating how the ski boot 31 and the mounting means 25, of which only the second mounting plate 28 is shown, overhang the inside edge 15 and the inner or first side 12 of the ski 11. This view also illustrates the tranverse adjustability of the mounting means 25 with respect to the inside edge 15 of the ski 11, with its consequent effect on the positioning of the boot 31 on the first or front mounting plate 26 (not shown) and the second or rear mounting plate 28. FIG. 6 also shows that the minimum angle formed with the horizontal through the inside edge by a line taken tangent to the inside edge 35 of the sole of the boot 31 and the bottom inside edge 15 is a minimum of 58 degrees. This means that a skier can tilt the ski 11 up on its inside edge 15 until an angle of about 58 degrees, with the mounting means transversely adjusted to its most inside or greatest offset position, before the boot will interfere with the snow surface. This same angle will be about 80 degrees with the mounting means transversely adjusted to its most outside or least offset position. This Figure also shows, because of the positioning of the skier's foot on the ski with respect to the bottom inside edge 15 of the ski 11, that less moment about the inside edge 15 is required to tilt the ski up on bottom inside edge 15 to initiate and execute a turn.

Figure 8:
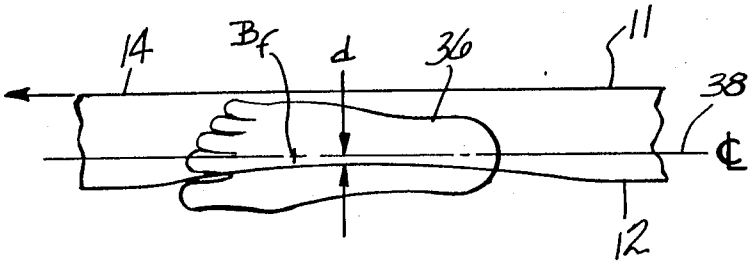
FIG. 8 is a partial top plan view diagrammatically depicting the positioning of the right foot of the skier with the centerline of the foot in relation to the inside edge and outside edge of the right ski.

This is further shown in FIG. 8 with respect to the skier's foot 36, which is diagrammatically illustrated as being positioned on the ski 11 between the first or inner side 12 and the second or outer side 14. The centerline 38 of the skier's foot 36 is shown at a distance d from the first side 12 and its attached bottom inside edge 15 at the waist of ski 11. Distance d is between about 5 and about 20 millimeters from the inside edge 15, but can be reduced to between about 5 and about 16 millimeters from the inside edge 15.

In the central portion of the ski point $B_f$ is shown in FIG. 8 taken through the ball of the foot along the centerline 38 of the skier's foot and parallel to the direction of travel. The point $B_f$ is located longitudinally along the ski with respect to the center of the contact length, lc/2, between about 50 millimeters to the front toward the shovel 19 and about 50 millimeters to the rear toward the tail 20 . The direction of travel is indicated by the arrow in FIG. 8, while the center of the contact length is seen in FIG. 7.

FIGS. 6 and 8 illustrate the key advantages of the ski of the present invention which permit a skier to initiate a turn with very little work by easily changing the angle of the ski with the ground by rotating up on the bottom inside edge 15 of the downhill ski 11. The tranverse adjustability of the mounting means 25 also affects the responsiveness and ease of initiating a turn of the ski 11. By moving the mounting means 25 more to the outer or second side 14, thereby reducing the amount of overhang of mounting means 25 with respect to the inner or first side 12 and inside edge 15, the responsiveness of the ski is reduced since it requires more work on the part of the skier and greater moment of inertia to change the angle of the ski 11 with respect to the ground, but increases the stability with greater speed.

The sidecut geometry of the ski, and specifically of the inner or first side and the bottom inside edges, also influences how small of a radius or tight of a turn a skier can accomplish naturally without any force being applied to the skis by the skier. The deeper the sidecut geometry, the sharper the turn or the smaller radius within which a turn can be accomplished. The ski 11 of the this invention combines the increased sidecut geometry with the positioning of the skier's foot and boot on the ski 11 to achieve a quicker transition to the on edge position which results in a more responsive ski and permits carved short radius turns to be easily accomplished by novice to intermediate skiers. It is to be understood that the inside edge is coincident with the sidecut as discussed in this description and is defined by the American Society of Testing and Materials (ASTM) standard F472-85.

Figure 7:
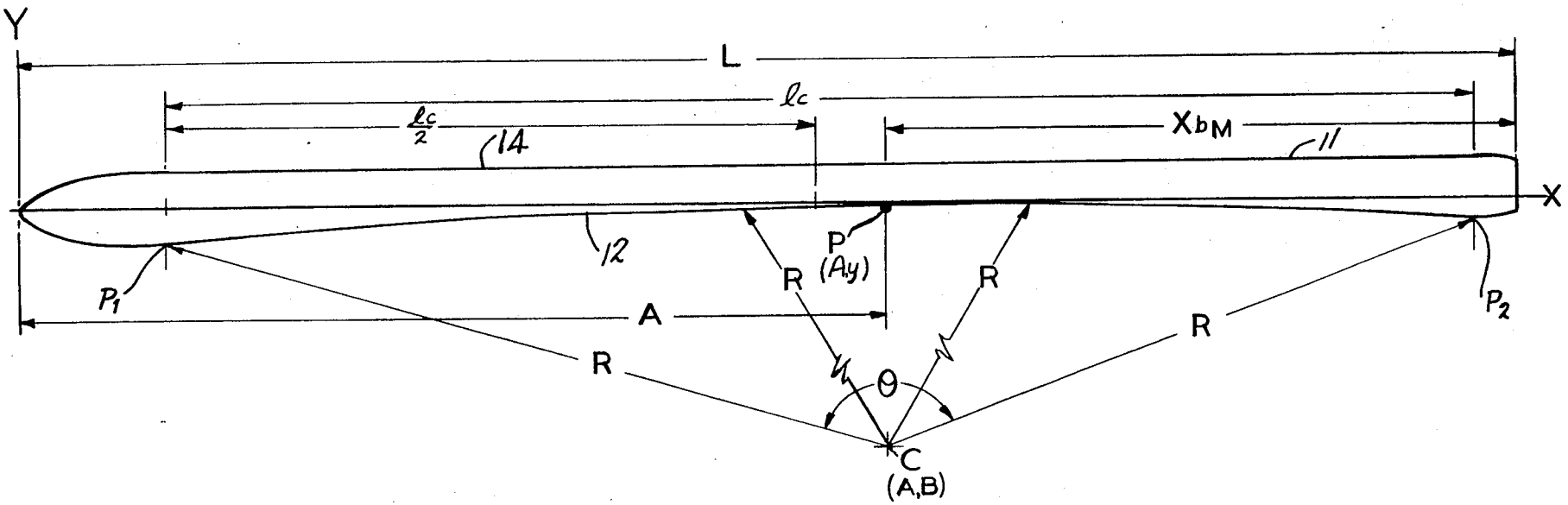
FIG. 7 is a top plan view of the right ski mounted on the X and Y axes to show the radius of the curvature of the sidecut and the location of the center of the circle from which the arc forming the sidecut is taken.

FIG. 7 shows this sidecut geometry on the ski 11 by placing the tip of the shovel of the ski 11 at the origin on the X and Y axes. The general formula for a circle in Cartesian space may then be applied to this plotting. This formula may be expressed in terms of the radius R of the curvature forming the sidecut geometry as $R=[(x-A)^2+(y-B)^2]^{\frac{1}{2}}$, where the radius is between about 10 meters and about 85 meters. A and B are equal to the x and y coordinates, respectively, of the center point C of the circle from which the arc is taken to achieve the sidecut geometry of the inner or first side 12 of the ski 11. A is equal to the x or abscissa value of the point P on the first side 12 in the waist or central section of the ski 11, while y is equal to the y or ordinate value of point P. In this instance, since the point P is located on the sidecut of the ski 11 at the waist, the ordinate is equal to B+R. The waist is defined by the previously mentioned ASTM as the narrowest point of the ski body between the widest part of the ski in the tail 20 and the widest part of the ski in the shovel 19. The center point C of the circle may be located at any distance along the X axis between about 0.550 to about 0.700 times the length L of the ski 11.

FIG. 7 further shows the length of the ski 11 from the tip of the shovel to the tip or rear edge of the tail as L and the contact length, lc, which extends between the points on the bottom running surface in the shovel and the tail where the running surface of the unloaded ski contacts a flat plane surface. Point P in FIG. 7 is shown as being located on the sidecut at the waist of the ski 11 and is measured at a distance $X_{bM}$ from the tip of the tail. The radius R swings through the sidecut of the ski 11 between the points $P_1$ and $P_2$ in the shovel and the tail where the radius breaks with the first side 12. The length of the arc between these points is calculated by the equation, length of arc$=(\pi R\theta)/180$. The angle $\theta$ is shown as illustrated and for skis of a length L of about 130 centimeters to about 210 centimeters will vary from between about 1.07° to about 10.67° and preferably between about 1.07° and about 8.90° for radii between about 10 and about 85 meters.

FIG. 7, with tip of the shovel of ski 11 at the origin of the Cartesian coordinate system and the X axis parallel to the direction of travel, permits the centerline 38 of the skier's foot in FIG. 8 to be seen as parallel to the X axis. The second or outer side 14 of ski 11 is also parallel to the direction of travel, indicated by the arrow in FIG. 8. The ball of the skier's foot is located at point $B_f$. The value of the angle $\theta$ can then be closely approximated by the formula for the length of a chord subtended by $\theta$, utilizing the contact length, 1c, for the approximate length of the chord, or $\text{Sin } \frac{1}{2}\theta \cong 1c/2R$.

Every ski has its own sidecut geometry. Traditionally skis have had a radius R of curvature forming the sidecut that has been greater than 90 meters. This large radius R of curvature forming the sidecut has meant that traditional skis turn in a wide path or large circle, without considerable extra effort on the part of the skier to initiate and carry the ski through the turn. In contrast, the ski of the present design has the ski do a substantial portion of the work required to initiate and complete a turn by having decreased the lever arm, lowered the moment of inertia about the inside edge 15, and shortened the radius of curvature forming the sidecut of the ski.

While the preferred structure in which the principles of the present invention have been incorporated as shown and described above, it is to be understood that the present invention is not to be limited to the particular details thus presented, but in fact, widely different means may be employed in the practice of the broader aspects of this invention. It is possible, for example that the ski boot sole can be offset from the remainder of the ski boot to attempt to achieve the same results. The scope of the appended claims is intended to encompass all obvious changes in the details, materials, and arrangements to structural parts that will occur to one of ordinary skill in the art upon a reading of this disclosure.

Having thus described the invention, what is claimed is:

1. In an alpine snow ski of desired length with a shovel and a tail on opposing ends, the shovel and the tail being connected by a first side and a second side having in combination:

(a) a bottom inside edge connected to the first side extending substantially the desired length;

(b) a bottom outside edge connected to the second side extending substantially the desired length; and (c) mounting means intermediate the shovel and the tail for receiving the foot of a skier, the foot having a heel, toes and a centerline extending longitudinally between the heel and the toes such that when the foot is positioned in the mounting means the distance between the centerline of the foot and the inside edge is between about 5 and about 20 millimeters and the centerline is in a non-intersecting relationship with the inside egde.

2. The apparatus according to claim 1 wherein the mounting means is adjustable transversely with respect to the inside edge of the ski.

3. The apparatus according to claim 1 wherein the mounting means further overhangs the inside edge of the ski.

4. The apparatus according to claim 2 wherein the mounting means comprise a first mounting plate and a second mounting plate, the first mounting plate being nearest the shovel.

5. The apparatus according to claim 1 wherein the inside edge has a sidecut with a short radius of curvature forming the sidecut.

6. The apparatus according to claim 5 wherein the outside edge is generally straight intermediate the shovel and the tail.

7. The apparatus according to claim 6 wherein the outside edge and the second side are parallel to the direction of travel of the ski.

8. The apparatus according to claim 5 wherein the radius of curvature forming the sidecut is described by the equation $$R=[(x-A)^2+(y-B)^2]^{\frac{1}{2}}$$

and R is between about 10 meters and about 85 meters.

9. The apparatus according to claim 1 wherein the mounting means has the foot of the skier in a ski boot thereon, the boot having a sole with an inside edge that overhangs the mounting means such that the angle between the horizontal through the inside edge of the ski and a line tangent to the inside edge of the sole of the ski boot and the inside edge is at least about 58 degrees.

10. The apparatus according to claim 4 wherein the first mounting plate further comprises a first side generally parallel to the outside edge and a second side having a front portion nearest the shovel angled inwardly toward the inside edge of the ski and a rear portion generally parallel to the outside edge.

11. The apparatus according to claim 1 wherein the mounting means further comprise bindings to retain the skier's foot and a boot surrounding the foot in position on the ski.

12. The apparatus according to claim 5 wherein the center of the curvature of the sidecut has an abscissa value between about 0.550 and about 0.700 times the desired length of the ski.

13. The apparatus according to claim 12 wherein the curvature of the sidecut is subtended by an angle of between about 1.07 and about 10.67 degrees.

14. The apparatus according to claim 13 wherein the curvature of the sidecut is subtended by an angle of between about 1.07 and about 8.90.

15. The apparatus according to claim 14 wherein the ski further has a contact length, the contact length further having a center.

16. The apparatus according to claim 15 wherein the foot further has a ball of the foot that is located along the centerline of the foot between about 50 millimeters to the front and about 50 millimeters to the rear of the center of the contact length.

17. The apparatus according to claim 16 wherein the desired length of the ski is between about 130 and 210 centimeters.

18. In an alpine snow ski of a desired length with an inside edge connected to a first side and an outside edge connected to a second side, a shovel having a tip located on the front of the ski and a tail having a rear edge located on the rear of the ski, the shovel and tail being connected by the first side and the second side, the distance between the tip of the shovel and the rear edge of the tail defining the length of the ski, the improvement comprising:

mounting means intermediate the shovel and the tail for receiving the foot and boot of a skier, the mounting means being adjustable transversely with respect to the inside edge of the ski and overhanging the inside edge.

19. The apparatus according to claim 18 wherein the boot has a sole inside edge, the sole inside edge overhanging the mounting means such that the angle between the horizontal through the inside edge of the ski and a line tangent to the sole inside edge and the inside edge is at least about 58 degrees.

20. The apparatus according to claim 18 wherein the mounting means further comprise a first mounting plate and a second mounting plate, the first mounting plate being nearest the shovel.

21. The apparatus according to claim 20 wherein the first mounting plate further comprises a first side generally parallel to the outside edge and a second side having a front portion nearest the shovel angled inwardly toward the inside edge of the ski and a rear portion generally parallel to the outside edge.

22. The apparatus according to claim 18 wherein the inside edge connected to the first side has a sidecut with a short radius of curvature forming the sidecut.

23. The apparatus according to claim 22 wherein the outside edge connected to the second side is generally straight intermediate the shovel and the tail.

24. The apparatus according to claim 23 wherein the outside edge connected to the second side is generally parallel to the direction of travel of the ski.

25. The apparatus according to claim 18 wherein the foot of the skier when positioned in the mounting means has a centerline extending longitudinally therethrough such that the distance between the centerline of the foot and the inside edge is between about 5 and about 20 millimeters.

26. The apparatus according to claim 18 wherein the boot has a centerline extending longitudinally therethrough such that when the boot is positioned in the mounting means the distance between the centerline of the boot and the inside edge is between about 5 and about 20 millimeters.

27. The apparatus according to claim 22 wherein the radius of curvature forming the sidecut is described by the equation $R=[(x-A)^2+(y-B)^2]^{\frac{1}{2}}$ and R is between about 10 meters and about 85 meters.

28. The apparatus according to claim 18 wherein the mounting means further comprise bindings to retain the boot and foot of the skier in position on the ski.

29. The apparatus according to claim 22 wherein the curvature forming the sidecut is an arc of a circle having a center, the center being the center of curvature of the sidecut.

30. The apparatus according to claim 29 wherein the center of curvature of the sidecut has an abscissa value when the ski is placed on horizontal and vertical axes in Cartesian space with the tip of the shovel placed at the origin, the abscissa value of the center of the sidecut being between about 0.550 and about 0.700 times the length of the ski.

31. The apparatus according to claim 30 wherein the curvature of the sidecut is subtended by an angle taken from the center of curvature of between about 1.07 and about 10.67 degrees.

32. The apparatus according to claim 30 wherein the curvature of the sidecut is subtended by an angle taken from the center of curvature of between about 1.07 and about 8.90 degrees.

33. The apparatus according to claim 25 wherein the ski further has a contact length, the contact length having a center.

34. The apparatus according to claim 33 wherein the foot further has a ball of the foot portion located along the longitudinally extending centerline of the foot, the ball of the foot portion being positioned in the mounting means on the ski between about 50 millimeters to the front and about 50 millimeters to the rear of the center of the contact length of the ski.

35. The apparatus according to claim 34 wherein the length of the ski is between about 130 and 210 centimers.

36. In an alpine snow ski, comprising in combination:

(a) a bottom inside edge, the edge having a sidecut;

(b) a generally straight bottom outside edge;

(c) a first side connected to the bottom inside edge;

(d) a second side connected to the bottom outside edge;

(e) a front end portion having a shovel connected to the first side and the second side, the shovel further having a tip;

(f) a rear end portion having a tail connected to the first side and the second side, the tail further having a rear edge;

(g) a central portion between the first side and the second side comprising the ski body having a top and a bottom extending a distance between the tip of the shovel and the rear edge of the tail, the distance defining the length of the ski; and (h) a radius of curvature defining the sidecut, the sidecut being an arc of a circle having a center, the center being the center of the curvature of the sidecut when the ski is placed on horizontal and vertical axes in Cartesian space with the tip of the shovel placed at the origin such that the radius of curvature is defined by the equation $R=[(x-A)^2+(y-B)^2]^{\frac{1}{2}}$.

37. The apparatus according to claim 36 wherein the radius of curvature is between about 25.91 m meters and about 85 meters.

38. The apparatus according to claim 36 wherein the bottom outside edge is generally parallel to the direction of travel of the ski.

39. The apparatus according to claim 38 wherein the center of the curvature of the sidecut has an abscissa value of between about 0.550 and about 0.700 times the length of the ski.

40. The apparatus according to claim 39 wherein the curvature of the sidecut is further subtended by an angle taken from the center of curvature of between about 1.07 and about 10.67 degrees.

41. The apparatus according to claim 39 wherein the curvature of the sidecut is further subtended by an angle taken from the center of curvature of between about 1.07 and about 8.90 degrees.

42. The apparatus according to claim 41 wherein the length of the ski is between about 130 and about 210 centimeters.

43. The apparatus according to claim 42 wherein the ski further has mounting means for receiving the foot and boot of a skier connected to the top thereof intermediate the shovel and the tail, the mounting means being adjustable transversely with respect to the bottom inside edge of the ski.

44. The apparatus according to claim 43 wherein the mounting means overhang the bottom inside edge of the ski.

45. The apparatus according to claim 44 wherein the foot of the skier when positioned in the mounting means has a centerline extending longitudinally therethrough such that the distance between the centerline of the foot and the bottom inside edge is between about 5 and about 20 millimeters.

46. The apparatus according to claim 44 wherein the boot of the skier when positioned in the mounting means has a centerline extending longitudinally therethrough such that the distance between the centerline of the boot and the bottom inside edge is between about 5 and about 20 millimeters.

47. The apparatus according to claim 45 wherein the ski further has a contact length, the contact length having a center.

48. The apparatus according to claim 47 wherein the boot has a sole inside edge, the sole inside edge overhanging the bottom inside edge and the mounting means such that the angle between the horizontal through the bottom inside edge and a line tangent to the sole inside edge and the bottom inside edge is at least about 58 degrees.

49. The apparatus according to claim 48 wherein the mounting means further includes bindings to retain the skier's foot and boot in position on the ski.

50. The apparatus according to claim 48 wherein the mounting means further comprise a first mounting plate and a second mounting plate, the first mounting plate being nearest the shovel.

51. The apparatus according to claim 50 wherein the first mounting plate further comprises a first side generally parallel to the bottom outside edge and a second side having a front portion nearest the shovel angled inwardly toward the bottom inside edge of the ski and a rear portion generally parallel to the bottom outside edge.

52. The apparatus according to claim 47 wherein the foot further has a ball of the foot portion located along the longitudinally extending centerline of the foot, the ball of the foot portion being positioned in the mounting means on the ski between about 50 millimeters to the front and about 50 millimeters to the rear of the center of the contact length of the ski.

53. In an alpine snow ski of desired length having a front end and a rear end, the ski being placed at the origin of horizontal and vertical axes in Cartesian space, comprising in combination:

(a) an inside edge connected to a first side, the inside edge having a sidecut with a short radius of curvature forming the sidecut the radius of curvature being described by the equation $R=[(x-A)^2+(y-B)^2]^{\frac{1}{2}}$, the sidecut further having a center of curvature that is the center of the arc of a circle;

(b) an outside edge connected to a second side, the outside edge being generally straight between the front end and the rear end;

(c) a shovel having a tip located on the front end of the ski;

(d) a tail having a rear edge located on the rear end of the ski, the shovel and tail being connected by the first side and the second side, the distance between the tip of the shovel and the rear edge of the tail defining the length of the ski such that the center of curvature of the sidecut when the tip of the shovel is placed at the origin of the horizontal and vertical axes has an abscissa value of between about 0.550 and about 0.700 times the length of the ski; and (e) mounting means intermediate the shovel and the tail for receiving the foot and boot of a skier, the mounting means being adjustable transversely with respect to the inside edge and overhanging the inside edge such that when the foot of the skier is positioned in the mounting means the foot has a longitudinally extending centerline between the shovel and the tail so that the distance between the centerline and the inside edge is between about 5 and about 20 millimeters.

54. The apparatus according to claim 53 wherein the radius R is between about 10 meters and about 85 meters.

55. The apparatus according to claim 53 wherein the curvature of the sidecut is subtended by an angle taken from the center of curvature of between about 1.07 and about 10.67 degrees.

56. The apparatus according to claim 55 wherein ski further has a contact length, the contact length further having a center.

57. The apparatus according to claim 56 wherein the foot of the skier has a ball of the foot portion located along the longitudinally extending centerline of the foot, the ball of the foot portion being positioned in the mounting means on the ski between about 50 millimeters to the front of the center of the contact length and about 50 millimeters to the rear of the center of the contact length of the ski.

58. The apparatus according to claim 57 wherein the outside edge connected to the second side is generally parallel to the direction of travel.

59. The apparatus according to claim 58 wherein the boot of the skier has a sole inside edge, the sole inside edge overhanging the mounting means such that the angle between the horizontal through the inside edge of the ski and a line tangent to the sole inside edge and the inside edge is at least about 58 degrees.

60. The apparatus according to claim 59 wherein the mounting means further comprise bindings.

61. A pair of alpine snow skis each of desired length with a front end and a rear end such that each ski may be placed at the origin of horizontal and vertical axes in Cartesian space, the pair comprising, in combination:

(a) a first ski for use on a right foot of a skier having a first inside edge with a sidecut defined by a short radius of curvature and a second outside edge that is generally straight between the front end and the rear end;

(b) a second ski for use on a left foot of the skier having a first inside edge with a sidecut defined by the short radius of curvature and a second outside edge that is generally straight between the front end and the rear end; and (c) mounting means intermediate the front end and the rear end of each of the first and second skis for receiving the foot and boot of a skier, each mounting means overhanging the inside edge of the corresponding first and second ski such that when the foot of the skier is positioned in the mounting means the foot has a longitudinally extending centerline between the front end and the rear end which is between about 5 and about 20 millimeters distance from the inside edge of the corresponding first and second ski.

62. The apparatus according to claim 61 wherein the radius of curvature of the first inside edge of the first and second ski is described by the equation $R=[(x-A)^2+(y-B)^2]^{\frac{1}{2}}$ where R is between about 10 and about 85 meters.

63. The apparatus according to claim 61 wherein the radius of curvature of each ski further has a center of curvature that is the center of an arc of a circle.

64. The apparatus according to claim 63 wherein each ski has a rear edge located on the rear end and a tip located on the front end, the rear edge and the tip being spaced a distance apart on each ski such that the distance therebetween defines the length of the ski.

65. The apparatus according to claim 64 wherein the center of curvature of the sidecut of each ski has an abscissa value when the tip of each ski is placed at the origin of the horizontal and vertical axes of between about 0.550 and about 0.700 times the length of each ski.

66. The apparatus according to claim 65 wherein the mounting means on each ski are transversely adjustable.

67. The apparatus according to claim 66 wherein the curvature of the sidecut is subtended by an angle taken from the center of curvature of between about 1.07 and about 10.67 degrees.

* * * * *